United States Patent [19]

Amano et al.

[11] Patent Number: 4,547,964

[45] Date of Patent: Oct. 22, 1985

[54] METHOD FOR THE MANUFACTURE OF A PRINTED-CIRCUIT BOARD CONNECTOR

[75] Inventors: Katutoshi Amano, Yokohama; Toshio Kakuta, Higashiosaka, both of Japan

[73] Assignees: Sony Corporation, Tokyo; Hosiden Electronics Co., Ltd., Osaka, both of Japan

[21] Appl. No.: 519,171

[22] Filed: Aug. 1, 1983

[30] Foreign Application Priority Data

Aug. 9, 1982 [JP] Japan ..... 57-138103

[51] Int. Cl.[4] ..... H01R 43/00

[52] U.S. Cl. ..... 29/883; 174/52 FP

[58] Field of Search ..... 29/883, 827; 174/52 FP; 339/17 F, 176 MF

[56] References Cited

U.S. PATENT DOCUMENTS 4,231,628 11/1980 Hughes et al. ..... 339/17 LC
4,337,574 7/1982 Hughes et al. ..... 29/883
4,445,736 5/1984 Hopkins ..... 29/827 X

FOREIGN PATENT DOCUMENTS 1528075 6/1968 France ..... 174/52 FP

*Primary Examiner*—Howard N. Goldberg
*Assistant Examiner*—Carl J. Arbes
*Attorney, Agent, or Firm*—Pollock, Vande Sande and Priddy

[57] ABSTRACT

A contact array plate having a plurality of contact pieces arranged to extend between first and second coupling pieces is formed by punching of a sheet of metal. A first housing half is molded integrally with the contact array plate so that intermediate portions of the contact pieces are buried in the first housing half. Then the first and second coupling pieces are cut off to separate the contact pieces from one another and outwardly projecting portions of the contact pieces are bent along shaped sections of the peripheral surface of the first housing half to form contact propers. A second housing half acting as bending dies is assembled with the first housing half with the contact propers inside thereof to define therebetween an insertion opening for receiving a mating connector.

9 Claims, 31 Drawing Figures

METHOD FOR THE MANUFACTURE OF A PRINTED-CIRCUIT BOARD CONNECTOR

BACKGROUND OF THE INVENTION

The present invention relates to a method of making a printed-circuit board connector for connection with a thin, miniaturized multi-connector formed at an end of a printed-circuit board, for example, a flexible printed-circuit board.

A conventional printed-circuit board connector for receiving a multi-connector formed at an end portion of a printed-circuit board is such as follows: A housing is formed by molding of an insulating material, such as a synthetic resinous material. An elongated opening is formed in the housing for insertion thereinto of a mating connector, a plurality of contact mounting grooves are formed in the opening at regular intervals in its lengthwise direction thereof, and contact pieces are inserted into and fixed to the contact mounting grooves one by one, thereby making the connector. Accordingly, a precise assembling operation is needed for mounting the contacts in the housing and the reduction of the pitch of arrangement of the contacts or miniaturization of the connector in its entirety would introduce difficulty in the manufacturing and assembling operation. Further, in order to prevent soldering flux, when soldering connector terminals for electrical connection, from flowing into the housing through the terminals, the prior art involves a special step for applying adhesive to terminal leading-out portions of the housing.

SUMMARY OF THE INVENTION

It is therefore an object of the present invention to provide a printed-circuit board connector manufacturing method which permits efficient fabrication, with a simple manufacturing process, of a connector having contact pieces arranged at small pitches.

According to the printed-circuit board manufacturing method of the present invention, a contact array plate, which has a plurality of contact pieces formed integrally with substantially parallel first and second coupling pieces to extend therebetween, is made out of a sheet of metal. Then a first housing half is molded integrally with the contact base plate so that its central portion may be buried in the housing half. After this, the first and second coupling portions of the contact base plate are cut out to separate the contact pieces into individual ones. Next, the contact pieces are bent along the peripheral surface of the first housing half to form contact propers. Then a second housing half is fixed to the first housing half with the contact propers inside the housing assembly. Between the first and second housing halves thus fixedly assembled is defined an insertion opening for receiving a mating connector.

DESCRIPTION OF THE PREFERRED EMBODIMENTS

A description will be given, with reference to the drawings, of an example of the printed-circuit board connector manufacturing method of the present invention.

Figure 1:
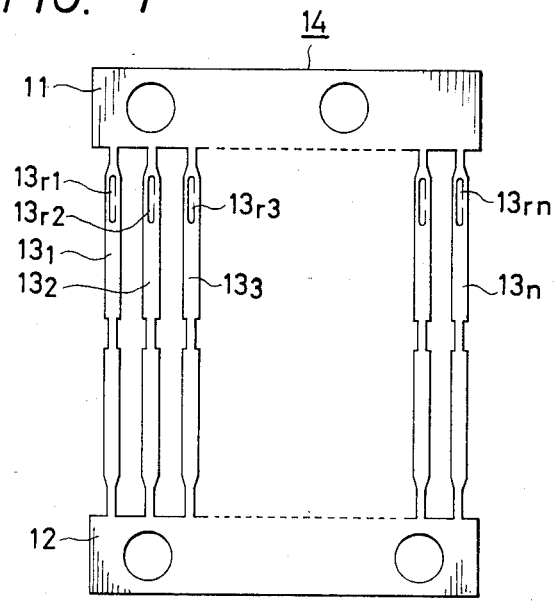
FIG. 1 is a plan view showing an example of a contact array plate.
Figure 2:
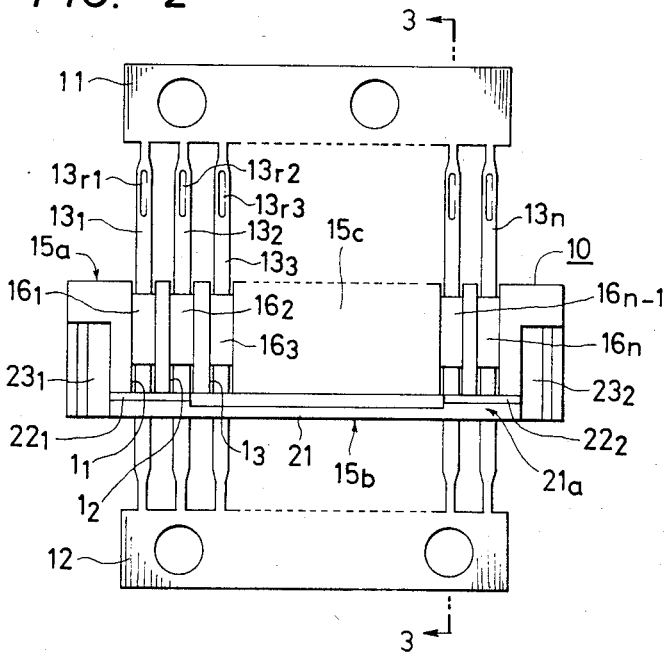
FIG. 2 is a plan view showing the contact array plate molded with a first housing half.
Figure 3:
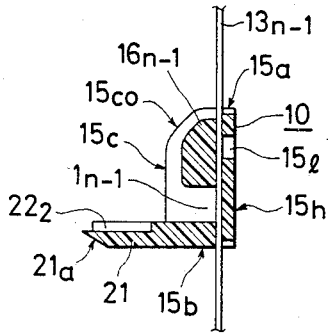
FIG. 3 is a cross-sectional view taken on the line 11—11 of FIG. 2.
Figure 4:
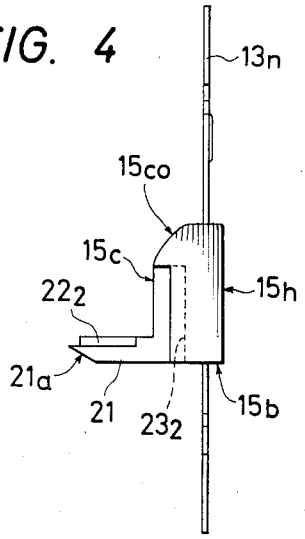
FIG. 4 is a right side view of FIG. 2.
Figure 5:
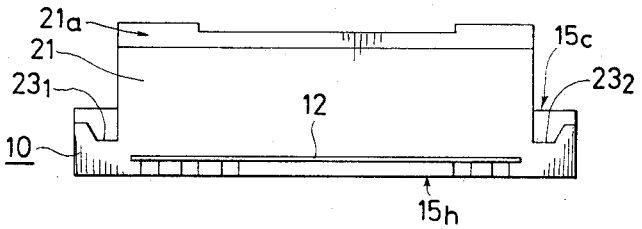
FIG. 5 is a front view of FIG. 2.
Figure 6:
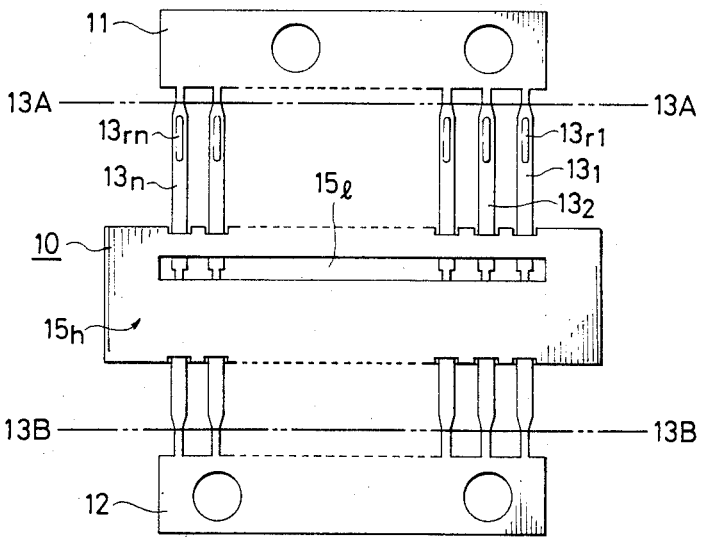
FIG. 6 is a bottom view of FIG. 2.

The manufacture starts with the preparation of a contact array plate 14 of the type as shown in FIG. 1 which is formed by a sheet of metal. The contact array plate 14 comprises first and second thin, rectangular parallel coupling pieces 11 and 12 and a plurality of band-shaped contact pieces $\mathbf{13}_1$, $\mathbf{13}_2$, . . . which are of the same shape and formed integrally with the coupling pieces 11 and 12 to extend therebetween and are arranged at regular intervals lengthwise thereof. The contact array plate 14 can be obtained by press work or chemical etching of sheet metal.

The contact pieces $13_1$, $13_2$, . . . have at one end contact portions $13_{r1}$, $13_{r2}$, . . . which are formed by press work to extend lengthwise thereof.

A first housing half 10 is formed by molding as a unitary structure with the contact array plate 14 in such a manner that the intermediate portions of its contact pieces may be buried in the housing half 10 as shown in FIGS. 2 to 6. The housing half 10 is a rectangular-parallelepiped-shaped molding of an insulator material, such as, for instance, synthetic resin and a surface **15*h* of the housing half 15 extending lengthwise thereof is substantially flat. The contact array plate 14 is assembled with the housing half 10 so that the central portions of the contact pieces $13_1$, $13_2$, . . . are buried therein in parallel with the abovesaid surface 15*h*, with their opposite end portions extending from surfaces 15*a* and 15*b* of the housing half 10 adjacent to the surface 15*h*. One marginal edge of a face 15*c* on the opposite side from the face 15*h* is rounded to form a curved face $15_{co}$ towards the face 15*h*. In the face 15*c* are cut parallel contact receiving grooves $16_1$, 16*2*, . . . corresponding to the positions of the contact pieces $13_1$, $13_2$, . . . , respectively. The contact receiving grooves $16_1$, $16_2$, . . . are extended at one end to a face 15*a* of the housing half 10** which is contiguous to the curved face $15_{co}$ and the other end portions of the grooves are cut deep to provide relieves $1_1$, $1_2$, . . . . The contact receiving grooves $16_1$, $16_2$, . . . are a little wider than the contact pieces $13_1$, $13_2$, . . . .

A thin, flat projecting base plate 21 is formed integrally with the first housing half 10 on a face **15*b* opposite from the face 15*a* to extend at right angles to the face 15*c*. The projecting base plate 21 has recesses $22_1$ and $22_2$ at both end portions thereof in the lengthwise direction of the housing half 10. The marginal edge of the projecting base plate 21 is tapered on the projecting end side thereof as indicated by 21*a*. Both end portions of the face 15*c* respectively have formed therein grooves $23_1$ and $23_2$ adjacent to the projecting base plate 21 to extend in parallel to the lengthwise direction of the contact pieces $13_1$, $13_2$, . . . . In order to hold the contact array plate 14 in a molding die during molding, an elongated groove 15*l* is cut in the face 15*h*** in the direction perpendicular to the contact pieces $13_1$, $13_2$, . . . .

From the viewpoint of improving productivity, it is also possible to form the first and second coupling pieces 11 and 12 in a further elongated shape, to form a plurality of sets of contact pieces $13_1$, $13_2$, . . . integrally with the coupling pieces 11 and 12 at regular intervals and to mold a plurality of the housing halves 10 as a unitary structure with the respective sets of contact pieces $13_1$, $13_2$, . . . .

Next, the plurality of contact pieces $13_1$, $13_2$, . . . of the contact array plate 14 are severed into individual contact pieces. That is, the first and second coupling pieces 11 and 12 of the contact array plate 14 molded integrally with the first housing half 10 as described above are cut off along broken lines 13A—13A and 13B—13B shown in FIG. 6 by a cutter to separate the interconnected contact pieces $13_1$, $13_2$, . . . into independent ones.

Figure 7:
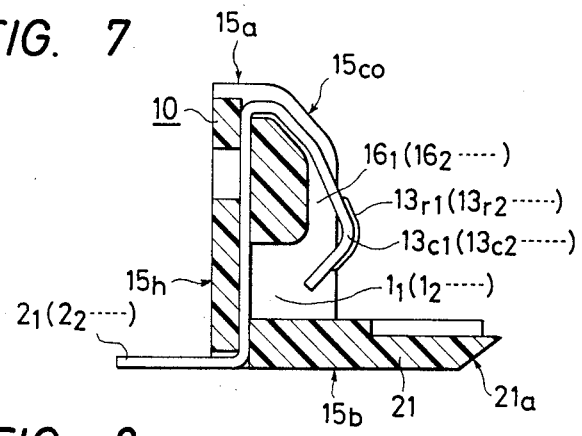
FIG. 7 is a cross-sectional view, corresponding to FIG. 3, showing the state in which contact pieces are bent.

The contact pieces $13_1$, $13_2$, . . . thus separated are bent through using the first housing half 10 as a bending die to form contact propers on the first housing half 10. That is, as shown in FIG. 7, the contact pieces $13_1$, $13_2$, . . . projecting out of the face **15*a* of the first housing half 10 are bent along curved surfaces of the corresponding contact piece receiving grooves $16_1$, $16_2$, . . . adjacent the top (as illustrated) of the housing half 10, and their free end portions are bent into the relieves $1_1$, $1_2$, . . . at the contact portions $13_{r1}$, $13_{r2}$, . . . . Removing the bending force, the contact pieces $13_1$, $13_2$, . . . , owing to their resiliency, spring back with their free end portions far away from the said curved surfaces of the contact piece receiving grooves $16_1$, $16_2$, . . . , providing contact propers $13_{c1}$, $13_{c2}$, . . . in position in the contact piece receiving grooves $16_1$, $16_2$, respectively. The contact propers $13_{c1}$, $13_{c2}$, . . . are resiliently displaceable in a direction perpendicular to the face 15*h*. It is also possible to bend the contact pieces $13_1$, $13_2$, . . . at the positions of the contact portions $13_{r1}$, $13_{r2}$, . . . first and then bend the contact pieces $13_1$, $13_2$, . . . along the said curved surfaces of the contact piece receiving grooves $16_1$, $16_2$, . . . respectively. Those portions of the contact pieces $13_1$, $13_2$, . . . projecting out of the face 15*b* of the first housing half 10 are bent towards the bottom of the housing half 10, i.e., along face 15*h*** to form terminals $2_1$, $2_2$, . . . , respectively.

Figure 8:
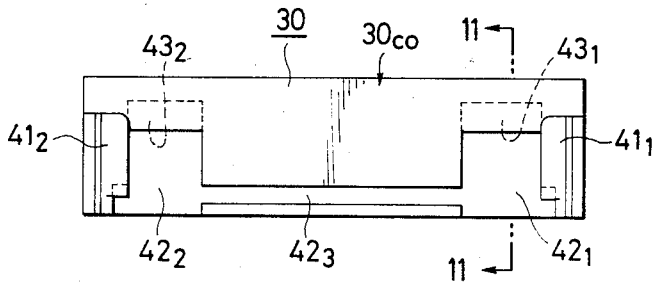
FIG. 8 is a plan view showing an example of a second housing half.
Figure 9:
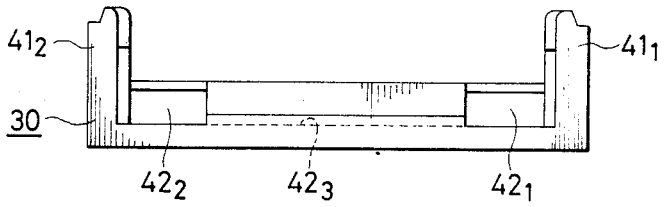
FIG. 9 is a front view of FIG. 8.
Figure 10:
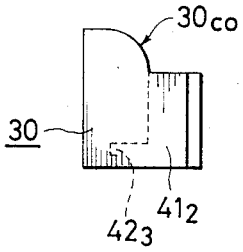
FIG. 10 is a left side view of FIG. 8.
Figure 11:
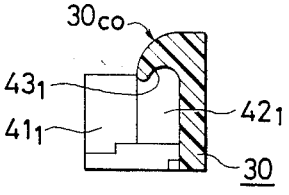
FIG. 11 is a cross-sectional view taken on the line 11—11 of FIG. 8.

Then a second housing half 30 is fixedly assembled with the first housing half 10 having the plurality of contact propers $13_{c1}$, $13_{c2}$, . . . . The second housing half 30 is preformed as a molding of an insulator, such as, for instance, a synthetic resin material. For example, as shown in FIGS. 8 to 11, the second housing half 30 has a thick board-like shape and its opposing end portions are extended at right angles to its face on the same side to form end pieces $41_1$ and $41_2$. One marginal edge of the second housing half 30 is rounded to form a curved face $30_{co}$ substantially similar to that $15_{co}$ of the first housing half 10 as shown in FIGS. 10 and 11. As illustrated in FIGS. 8 and 9, fixture mounting recesses $42_1$ and $42_2$ are formed in the face of the second housing half 30 on the inside of the end pieces $41_1$ and $41_2$ and in contact therewith. The recesses $42_1$ and $42_2$ intercommunicate through a coupling recess $42_3$ on the side of the marginal edge of the second housing half 30 on the opposite side from the marginal edge where the curved face $30_{co}$ is formed. The recesses $42_1$ and $42_2$ extend towards the curved face $30_{co}$ to form depressions $43_1$ and $43_2$ thereunder, respectively.

Figure 12:
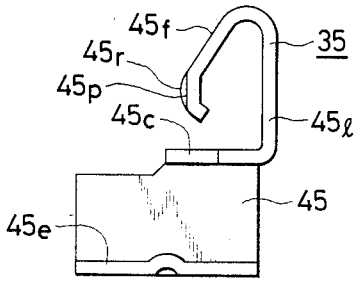
FIG. 12 is a front view of a fixture 35.
Figure 13:
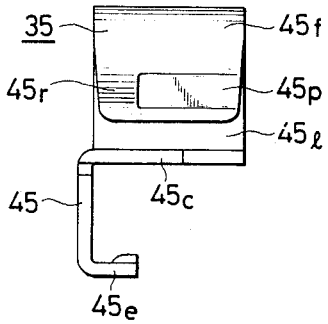
FIG. 13 is a left side view of FIG. 12.

Fixtures 35 and 36 are mounted in the recesses $42_1$ and $42_2$ of the second housing half 30, respectively. The both fixtures are formed by bending sheet metal of, for example, phosphor bronze into the same shape but symmetrical with each other. As shown in FIGS. 12 and 13 which illustrate the fixture 35, one marginal portion of a substantially rectangular plate member 45 is bent at right angles to extend therefrom to form a bent piece **45*e*. Substantially one half portion of the other marginal portion of the plate member 45 is bent to extend in the same direction as the bent piece 45*e* to form a coupling piece 45*c*. One marginal portion of the coupling portion 45*c* is bent to form an extended portion 45*l* perpendicular to both the plate member 45 and the coupling portion and its end portion is folded back to form a resilient portion 45*f*. The resilient portion 45*f* has at its end a portion bent inwardly and more than a half part of the bent angle in the width direction is pressed flat to form a plateau 45*p*, leaving a ridge 45*r*. The fixture 36 is formed into a shape identical but symmetrical with the fixture 35** of such a shape as described above.

Figure 14:
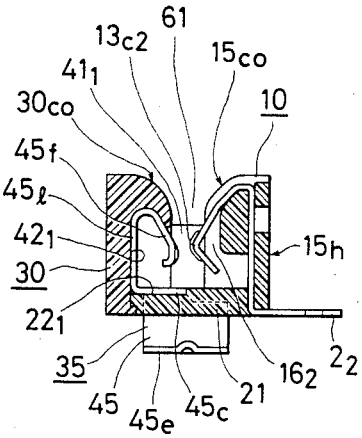
FIG. 14 is a cross-sectional view, corresponding to FIG. 3, showing a connector produced according to the present invention.
Figure 16:
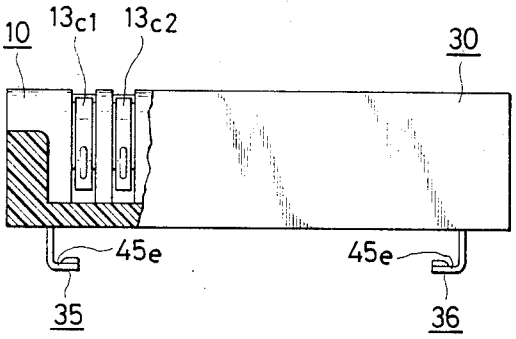
FIG. 16 is a front view, partly cut away, of FIG. 15.

As illustrated in FIG. 14, the fixture 35 is attached to the recess $42_1$ of the second housing half 30 in such a manner that the extended portion 45*l* abuts against the bottom of the recess $42_1$, the plate member 45 extends along the end piece $41_1$ and the bent piece 45*c* extends along one marginal edge of the second housing half 30 towards its center. In exactly the same manner the fixture 36 is attached to the recess $42_2$ of the second housing half 30. The fixtures 35 and 36 mounted on the second housing half 30 are held with their bent pieces 45*e* facing each other.

Figure 15:
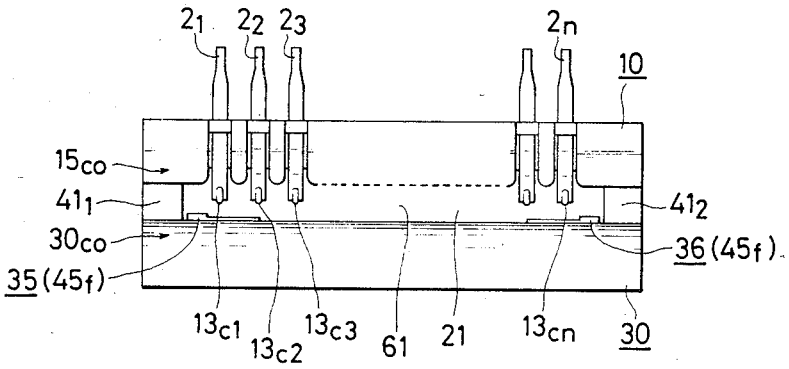
FIG. 15 is a plan view of the connector shown in FIG. 14.
Figure 17:
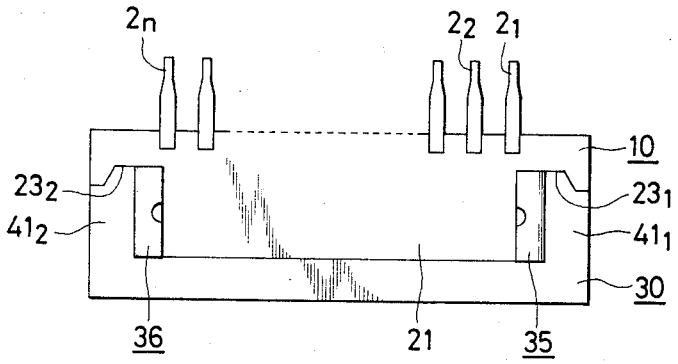
FIG. 17 is a bottom view of FIG. 15.

As shown in FIGS. 14 to 17, the second housing half 30 is assembled with the first housing half 10. That is, as shown in FIG. 17, the projecting base plate 21 of the first housing half 10 is inserted between the end pieces $41_1$ and $41_2$ of the second housing half 30 and the end portions of the end pieces $41_1$ and $41_2$ are fitted into the grooves $23_1$ and $23_2$ of the first housing half 10 and, further, the end edge of the projecting base plate 21 is fitted into the coupling recess $42_3$. The coupling pieces 45*c* of the fixtures 35 and 36 are positioned in the recesses $22_1$ and $22_2$ of the projecting base plate 21, the bent portions between the extended portions 45*l* and the resilient portions 45*f* of the fixtures 35 and 36 are inserted into and engaged with the depressions $43_1$ and $43_2$, respectively, and the fixtures 35 and 36 are held between the depressions $43_1$, $43_2$ of the second housing half 30 and the projecting base plate 21 of the first housing half 10. The first and second housing halves 10 and 30 thus assembled are fusion welded by ultrasonic waves as a unitary structure. The tapered face 21*a* of the projecting piece 21 is formed for facilitating the ultrasonic fusion. By assembling both housing halves in the manner described, their curved faces $15_{co}$ and $30_{co}$ face each other to define therebetween an opening 61 for receving a connector to be connected as shown in FIGS. 14 and 15.

Figure 18:
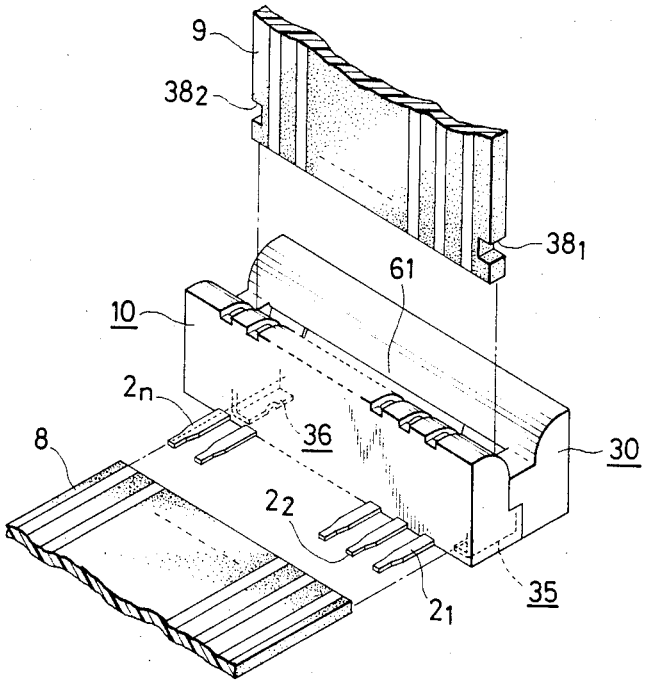
FIG. 18 is a perspective view illustrating an example of the connector produced according to the present invention, a mating connector and a printed-circuit board on which the connector is mounted.

With the circuit board connector thus produced, a mating circuit board connector 9 is inserted into the opening 61 for connection therewith, for example, as shown in FIG. 18. In this case, the curved faces $15_{co}$ and $30_{co}$ of the first and second housing halves 10 and 30 facilitate smooth insertion of the circuit board connector 9 into the opening 61. A printed-circuit board 8 is held between the bent pieces 45*e* of the fixtures 35 and 36 and the faces of the first and second housing halves 10 and 30 on the opposite side from the opening 61, not shown in FIG. 18, and terminals $2_1$, $2_2$, . . . are respectively soldered to circuits on the printed-circuit board 8. Notches $38_1$ and $38_2$ are formed in both marginal portions of the insertion end of the circuit board connector 9 and when the circuit board connector 9 is inserted into the opening 61 of the connector, the plateaus 45*p* of the resilient portions 45*f* of the fixtures 35 and 36 press the circuit board connector 9 against the contact propers $13_{c1}$, $13_{c2}$, . . . and the ridges 45*r* engage with the notches $38_1$ and $38_2$ to stably lock the circuit board connector 9 in its installed state. Thus the fixtures 35 and 36 serve both to hold the circuit board 8 and to lock the circuit board connector 9 in its installed state.

When the circuit board connector 9 is inserted into and held in the opening 61, the contact propers $13_{c1}$, $13_{c2}$, . . . respectively make resilient contact with contact portions of the circuit board connector 9 and resiliently displace towards the bottoms of the contact piece receiving grooves $16_1$, $16_2$, . . . . In this case, the overall reaction force of the contact propers $13_{cl}$, $13_{c2}$, . . . produces an action of curving the first housing half 10 in a direction perpendicular to the direction in which the circuit board connector 9 is inserted into the opening 61. However, the portion of the first housing half 10 forming the contact receiving grooves $16_1$, $16_2$, . . . is made relatively thick; consequently, the first housing half 10 is able to well withstand the abovesaid curving action, ensuring good contact of the contact propers $13_{c1}$, $13_{c2}$, . . . with the contact portions of the circuit board connector 9. In addition, the curved surfaces of the contact receiving grooves $16_1$, $16_2$, . . . can be used as the bending dies for bending the contact propers $13_{cl}$, $13_{c2}$, . . . as described previously.

Figure 19:
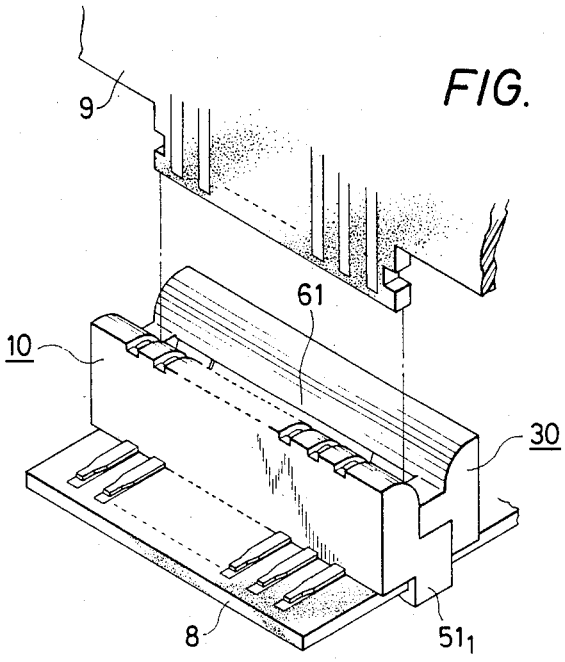
FIG. 19 is a perspective view showing another example of the connector produced according to the present invention, the mating connector and a printed circuit board on which the connector is mounted.
Figure 20:
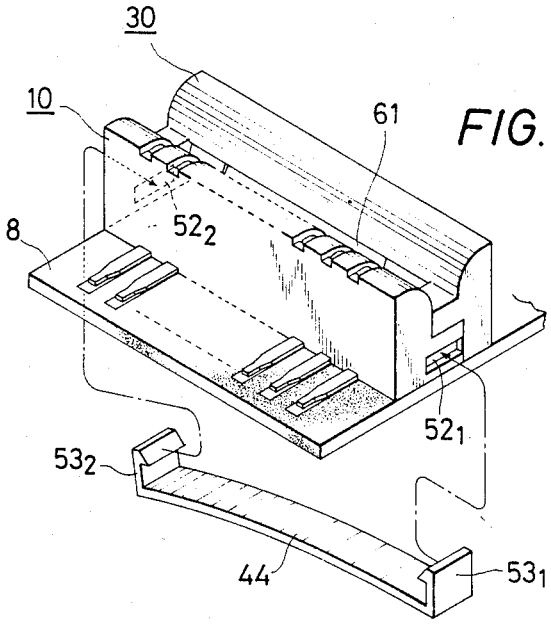
FIG. 20 is a perspective view showing another example of the connector produced according to the present invention and a printed-circuit board on which the connector is mounted.

The fixtures 35 and 36 may be omitted but, in such a case, as shown in FIG. 19, engaging pieces $51_1$ and $51_2$ ($51_2$ being not illustrated) are formed integrally with both end portions of the first housing half 10 to extend on the opposite side from the opening 61 and, by use of the engaging pieces $51_1$ and $51_2$, the connector is fixed to the circuit board 8. Also it is possible to adopt an arrangement of the type shown in FIG. 20 in which engaging grooves $52_1$ and $52_2$ are formed in both end faces of the first housing half 10, the circuit board 8 is held between the connector and a fixing piece 44, and engaging pieces $53_1$ and $53_2$ at both ends of the fixing piece 44 are engaged with the engaging grooves $52_1$ and $52_2$, respectively.

Figure 21:
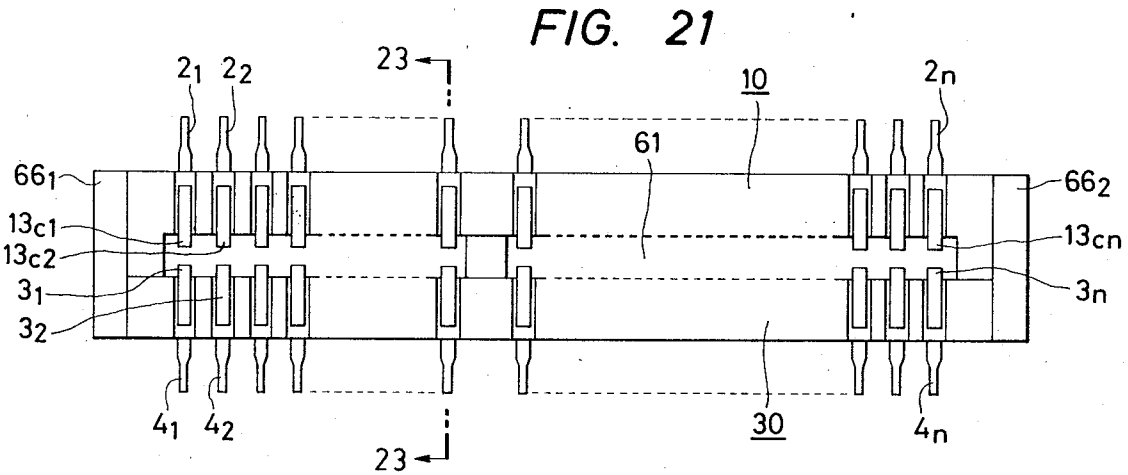
FIG. 21 is a plan view illustrating still another example of the connector produced according to the present invention.
Figure 22:
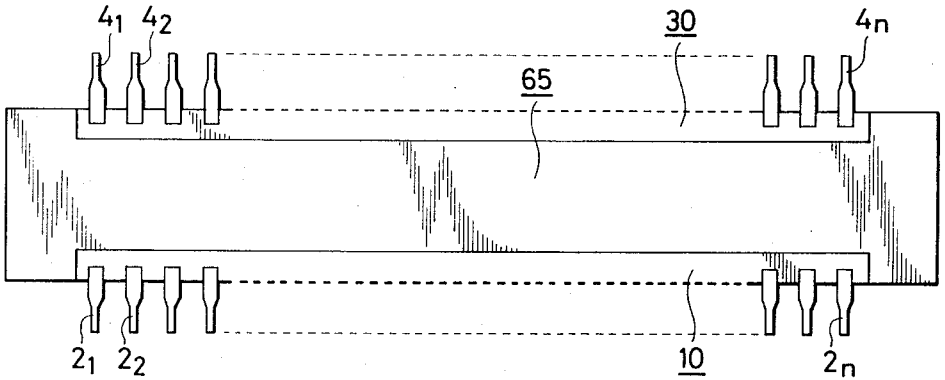
FIG. 22 is a bottom view of FIG. 21.
Figure 23:
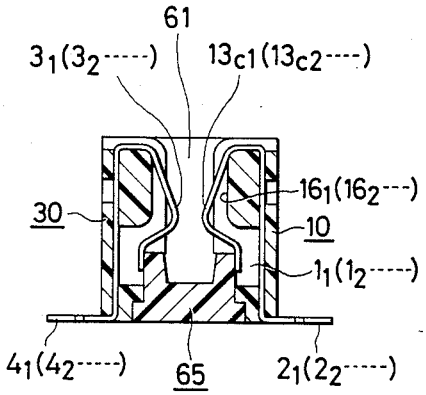
FIG. 23 is a cross-sectional view taken on the line 23—23 of FIG. 21.
Figure 25:
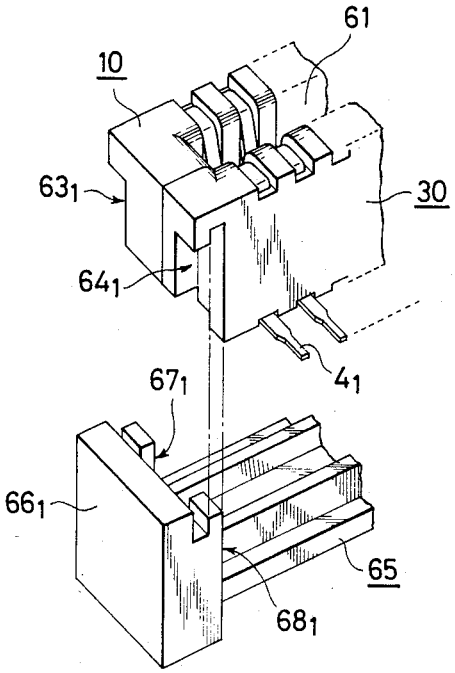
FIG. 25 is a perspective view showing one part of each of the first and second housing halves assembled together and a coupling block disassembled therefrom.
Figure 24:
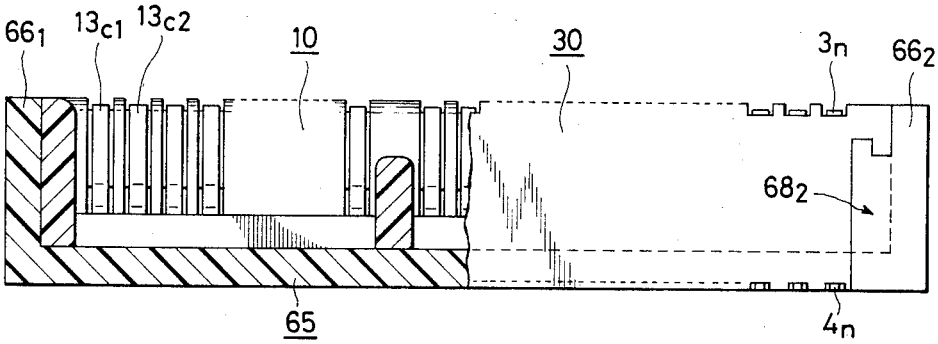
FIG. 24 is a front view, partly cut away, of FIG. 21.

Incidentally, the second housing half 30 may also be provided with contact propers. For instance, as illustrated in FIGS. 21 to 25, the intermediate portions of contact pieces are buried in the second housing half 30 and the contact pieces are bent through using the surfaces of contact piece receiving grooves to form contact propers $3_1$, $3_2$, . . . and terminals $4_1$, $4_2$, . . . are led out therefrom. As mainly shown in FIG. 25, fitting recesses $63_1$, $63_2$ and $64_1$, $64_2$ ($63_2$ and $64_2$ being not illustrated) are formed in the corners of both end portions of the first and second housing halves 10 and 30, respectively. A coupling block 65 made of a synthetic resinous material is fitted into the gap between the first and second housing halves 10 and 30 on the back thereof. As shown in FIGS. 21, 24 and 25, holding members $66_1$ and $66_2$ are formed integrally with both end portions of the coupling block 65 to extend therefrom in the same direction perpendicular to the major surface thereof, and guide projections $67_1$, $67_2$ and $68_1$, $68_2$ ($67_2$ being not illustrated) formed in both side portions of the opposing faces of the holding member $66_1$ and $66_2$ are fitted into the recesses $63_1$, $63_2$ and $64_1$, $64_2$, respectively, thus assembling the first and second housing halves 10 and 30 by the coupling block 65. The first and second housing halves 10 and 30 thus assembled are fusion-welded by ultrasonic waves as required.

Figure 26:
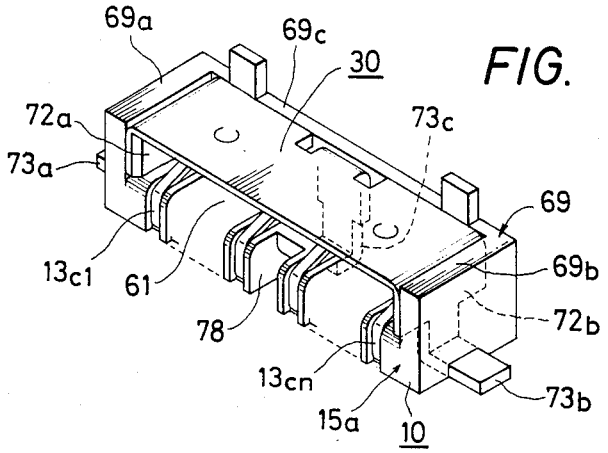
FIG. 26 is a perspective view illustrating another example of the connector produced according to the present invention.
Figure 27:
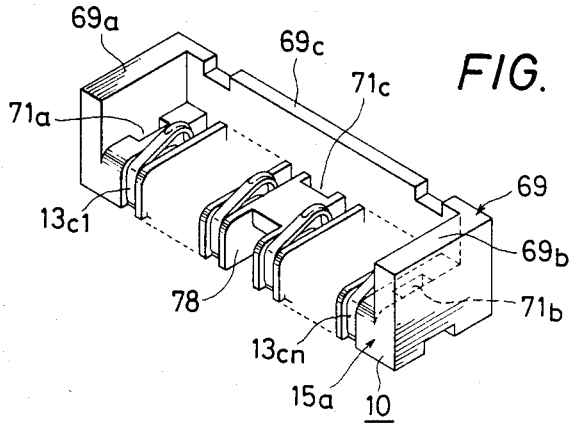
FIG. 27 is a perspective view showing the first housing half in FIG. 26.
Figure 28:
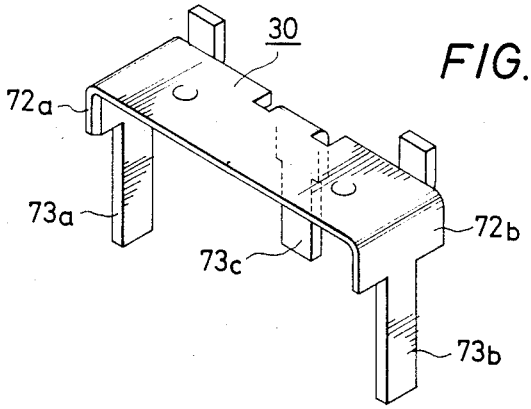
FIG. 28 is a perspective view showing the second housing half in FIG. 26.
Figure 29:
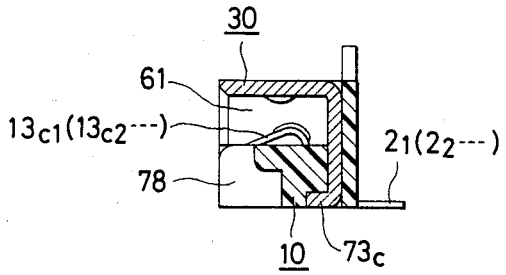
FIG. 29 is a cross-sectional view, corresponding to FIG. 14, of FIG. 26.

The second housing half 30 need not always be made of the synthetic resinous material but may also be formed, for example, from a sheet of metal. For instance, as shown in FIGS. 26 through 28, a peripheral wall 69 is formed integrally with the first housing half 10 to extend from the marginal portion of the contact piece housing groove forming face except on the side of the face 15*a* and through holes 71*a* and 71*b* are made in the first housing half 10 in contact with the inner surfaces of opposing portions 69*a* and 69*b* and, further, a through hole 71*c* is made in the first housing half 10 in contact with the inner surface of the intermediate portion 69*c* of the peripheral wall 69 between the opposing portions 69*a* and 69*b* thereof. The second housing half 30 is formed by a rectangular metal sheet as shown in FIGS. 26 and 28 and its opposing end portions are bent in the same direction to form bent portions 72*a* and 72*b*. Formed integrally with the bent portions 72*a* and 72*b* are fixing pieces 73*a* and 73*b* which extend therefrom into the through holes 71*a* and 71*b* of the first housing half 10, holding the bent portions 72*a* and 72*b* between the opposing end portions 69*a* and 69*b* of the first housing half 10. Projecting end portions of the fixing pieces 73*a* and 73*b* are bent to fix the second housing half 30 to the first housing half 10 as seen in FIG. 26. From the intermediate portion of one marginal portion of the second housing half 30 along its lengthwise direction is extended a fixing piece 73*c* in the same direction as the fixing pieces 73*a* and 73*b* and inserted into the through hole 71*c* of the first housing half 10 and then bent as shown in FIG. 29, thereby preventing the intermediate portion of the first housing half 10 from curving.

Figure 30:
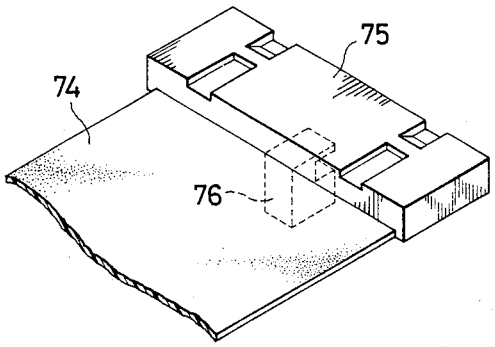
FIG. 30 is a perspective view showing a flexible printed-circuit board connector.
Figure 31:
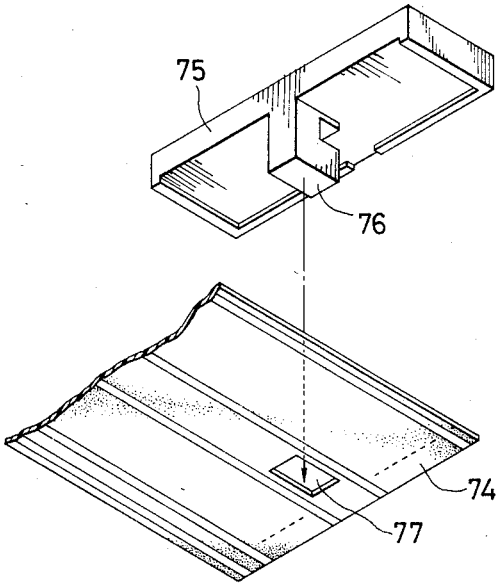
FIG. 31 is an exploded perspective view of FIG. 30.

The mating connector for the connector of the present invention is not limited specifically to a plate-shaped element of the type shown in FIG. 18 but may also be a flexible substrate, that is, a sheet-shaped connector. For example, as illustrated in FIGS. 30 and 31, a reinforcing piece 75 is mounted on one end portion of a flexible printed-circuit board 74 along its marginal edge. An L-shaped engaging piece 76 is formed integrally with the reinforcing piece 75 centrally thereof and is projected out through an aperture 77 made in the flexible printed-circuit board 74, and the end portion of the flexible printed-circuit board 74 is inserted into the connector insertion opening 61 along with the reinforcing piece 75. The L-shaped engaging piece 76 is inserted into an engaging recess 78 formed in the intermediate portion of the front of the first housing half 10, for instance, in the case of the connector shown in FIGS. 26 and 29.

As has been described in the foregoing, according to the present invention, since the contact pieces $13_1$, $13_2$, . . . are held integrally with the first housing half 10 and since the contact pieces $13_1$, $13_2$, . . . are formed from a sheet of metal into the contact array plate 14, the contact pieces with a minimum pitch can be accurately positioned relative to the first housing half 10. Further, since the contact pieces are bent along the bending dies formed in the peripheral surface of the first housing half 10, that is, along surfaces of the contact piece receiving grooves $16_1$, $16_2$, . . . , the contact propers can be obtained with high density. All of the contact pieces can be bent simultaneously. Moreover, the size of the connector in the direction of insertion of the mating connector can be reduced. By fusion-welding the second housing half 30 to the first housing half 10, for instance, through ultrasonic welding, it is possible to prevent soldering flux from entering into the housing assemlby. Besides, since the contacts are molded integrally with the first housing half 10, soldering flux is restricted from entering into the first housing half 10 during soldering of the terminals $1_1$, $1_2$, . . . .

The connector of the present invention resists deformation thereof upon the insertion thereinto of the mating connector and provides good contact therewith. In addition, means for holding and fixing the printed-circuit board 8 having connected thereto the contact terminals $1_1$, $1_2$, . . . can also be easily assembled with connector during the manufacturing process thereof.

It will be apparent that many modifications and variations may be effected without departing from the scope of the novel concepts of the present invention.

What is claimed is:

1. A printed-circuit board connector manufacturing method comprising:

forming out of a sheet of metal a contact array plate having substantially parallel first and second coupling pieces and a plurality of contact pieces formed integrally therewith to extend therebetween;

molding a first housing half of a synthetic resinous material integrally with the contact array plate so that the intermediate portions of the contact pieces are embedded in the molding and the two ends of each of said contact pieces project outwardly from an exterior face of said first housing half, said first housing half being shaped to define a plurality of contact receiving grooves that correspond respectively to said plurality of contact pieces and extend parallel to said contact pieces, each of said contact receiving grooves comprising a top surface of said first housing half which is spaced from the embedded intermediate portion of the contact piece to which said groove corresponds and which is formed to act as a bending die for an outwardly projecting end of a corresponding contact piece, the shape of each said top surface including a curved surface portion adjacent said outwardly projecting ends of the associated contact piece which curved portion merges into a further surface portion that extends in a direction generally parallel to the embedded intermediate portion of the corresponding contact piece;

cutting off the first and second coupling pieces of the contact array plate assembled with the first housing half to separate the plurality of contact pieces from one another;

bending the outwardly projecting end portions of the plurality of separated contact pieces which are disposed adjacent said curved surface portions of said top surfaces into contact with and along the curved surface portions of the corresponding contact receiving grooves in said first housing half to form contact propers whose bent configurations are defined by the shapes of said top surfaces acting as bending dies;

said molded first housing half having a bottom surface adjacent the other outwardly projecting end portions of the plurality of separated contact pieces, bending the outwardly projecting other end portions of the plurality of separated contact pieces which are disposed adjacent said bottom surface into engagement with said bottom surface to form contact terminals; and fixedly assembling a second housing half with the first housing half with said contact propers disposed between said first and second halves, said assembly being effected in a manner to define an insertion opening between said first and second housing halves for receiving a mating connector that engages said contact propers.

2. A printed-circuit board connector manufacturing method according to claim 1, wherein said contact receiving grooves extend to the position from which the contact pieces project outwardly from one face of the first housing half.

3. A printed-circuit board connector manufacturing method according to claim 1 wherein said curved surface portion of said top surface is disposed adjacent one of a pair of opposing faces of said first housing half, said further surface portion of said top surface extending toward but terminating short of the other of said opposing faces, each of said contact receiving grooves being shaped to provide a comparatively deep relief in the region between the termination of said further surface portions and said other opposing face, said bending step including bending the free ends of said outwardly projecting portions of said contact pieces into said reliefs.

4. A printed-circuit board connector manufacturing method according to claim 1 including the step of inserting a pair of opposing fixtures into said assembled housing halves so that said fixtures project out of both end portions of the face of the assembly of the first and second housing halves on the opposite side thereof from said insertion opening, said fixtures being shaped and positioned to hold a printed-circuit board between the fixtures and the first and second housing halves thereby to fix the connector to the printed-circuit board.

5. A printed-circuit board connector manufacturing method according to claim 4, wherein the fixtures are each formed by bending a sheet of metal into a shape which includes a resilient portion that extends into said insertion opening, the resilient portion being bent to define a ridge to be engaged with the mating connector inserted into the insertion opening to prevent disengagement of the mating connector.

6. A printed-circuit board connector manufacturing method according to claim 1 including the step of forming at least one of said housing halves to provide engaging means for fixing the connector to a printed-circuit board, said engaging means being formed integrally with both end portions of said one of the first and second housing halves.

7. A printed-circuit board connector manufacturing method according to claim 1, wherein the second housing half is a molding of a synthetic resinous material, said assembling step comprising fusion welding said second housing half to the first housing half by ultrasonic welding.

8. A printed-circuit board connector manufacturing method according to claim 1, wherein a second plurality of contact pieces are molded integrally with the second housing half with their intermediate portions fixed thereto and with their end portions projecting outwardly from a face of said second housing half, bending the outwardly projecting end portions of said second plurality of contact pieces into contact with and along a shaped peripheral surface of the second housing half acting as a bending die to form further contact propers whose bent configurations are defined by the shape of said peripheral surface, and assembling the first and second housing halves together with their respective contact propers disposed in spaced facing relation to one another.

9. A printed-circuit board connector manufacturing method according to claim 1, wherein the second housing half is a sheet of metal.

* * * * *